US012649552B2

(12) United States Patent
Pasteris

(10) Patent No.: US 12,649,552 B2
(45) Date of Patent: Jun. 9, 2026

(54) AUTONOMOUS SUBMERSIBLE SENSOR APPARATUS WITH PISTON DIVE CONTROL

(71) Applicant: University of Massachusetts, Boston, MA (US)

(72) Inventor: Patrick R. Pasteris, Swansea, MA (US)

(73) Assignee: University of Massachusetts, Boston, MA (US)

( * ) Notice: Subject to any disclaimer, the term of this patent is extended or adjusted under 35 U.S.C. 154(b) by 420 days.

(21) Appl. No.: 18/555,489

(22) PCT Filed: Apr. 28, 2022

(86) PCT No.: PCT/US2022/026781

§ 371 (c)(1),
(2) Date: Oct. 13, 2023

(87) PCT Pub. No.: WO2022/232428

PCT Pub. Date: Nov. 3, 2022

(65) Prior Publication Data

US 2024/0199182 A1 Jun. 20, 2024

Related U.S. Application Data

(60) Provisional application No. 63/182,267, filed on Apr. 30, 2021.

(51) Int. Cl.
*B63G 8/22* (2006.01)
*B63G 8/00* (2006.01)

(52) U.S. Cl.
CPC ..... *B63G 8/001* (2013.01); *B63G 8/22* (2013.01); *B63G 2008/004* (2013.01)

(58) Field of Classification Search
CPC . B63G 8/001; B63G 8/22; B63G 8/24; B63G 2008/004; B63B 2207/02
See application file for complete search history.

(56) References Cited

U.S. PATENT DOCUMENTS 3,860,983 A 1/1975 Furth et al.
4,191,049 A 3/1980 Bowditch et al.
(Continued)

FOREIGN PATENT DOCUMENTS

CN 105836082 A * 8/2016 ..... B63G 8/14
CN 106628077 A * 5/2017 ..... B63G 8/22
GB 143290 A 5/1920

OTHER PUBLICATIONS

N. N. Soreide, C. E. Woody and S. M. Holt, "Overview of ocean based buoys and drifters: present applications and future needs," MTS/IEEE Oceans 2001. An Ocean Odyssey. Conference Proceedings (IEEE Cat. No. 01CH37295), Honolulu, HI, USA, 2001, pp. 2470-2472 vol. 4, doi: 10.1109/OCEANS.2001.968388.
(Continued)

*Primary Examiner* — Andrew Polay
(74) *Attorney, Agent, or Firm* — Hinckley Allen & Snyder; Stephen Holmes

(57) ABSTRACT

A lightweight, efficient, autonomous sub-surface water data profiler (10) that can be easily programmed and deployed to collect sample data at a variety of water depths is disclosed. The profiler is a unique, simple-to-use, low-cost design with a low-cost depth control system that allows several dive/surface trips, an Android graphical interface for Bluetooth programming and a deployable antenna for retrieval after completing its mission. The collected data is achieved using an open-source Android interface and Bluetooth programming using Android and longer-range radio communications with a deployable antenna. The profiler is usable by anyone with a deep pond, lake, ocean or even a pool that they would like to monitor.

10 Claims, 7 Drawing Sheets

(56) References Cited

U.S. PATENT DOCUMENTS

| | | | | |
|---|---|---|---|---|
| 4,266,500 | A | 5/1981 | Jurca | |
| 5,283,767 | A * | 2/1994 | McCoy | B63B 22/20 367/4 |
| 6,807,856 | B1 * | 10/2004 | Webb | B63B 22/18 73/170.29 |
| 7,054,230 | B1 | 5/2006 | Nelson | |
| 8,205,570 | B1 * | 6/2012 | Tureaud | B63G 8/14 114/330 |
| 8,448,592 | B2 | 5/2013 | Crowell et al. | |
| 2012/0204775 | A1 * | 8/2012 | Watanabe | B63G 8/22 114/56.1 |

OTHER PUBLICATIONS

Waldmann, Christoph "Performance data of a buoyancy driven deep sea YOYO-profiler for long term moored deployment" Conference: Oceans '99 MTS/IEEE. Riding the Crest into the 21st Century, vol. 3. Feb. 1, 1999.

Russ E. Davis, "Development of an Air-Deployable Ocean Profiler" Defense Technical Information Center, ADA556859. Sep. 30, 2011.

Hashemi, S, & Durfee, WK. "Low Friction, Long-Stroke Rolling Diaphragm Cylinder for Passive Hydraulic Rehabilitation Robots." Proceedings of the 2017 Design of Medical Devices Conference. 2017 Design of Medical Devices Conference. Minneapolis, Minnesota, USA. Apr. 10-13, 2017. V001T05A016. ASME. https://doi.org/10.1115/DMD2017-3518.

T. P. Stanton, W. J. Shaw, M. Truffer, H. F. J. Corr, L. E. Peters, K. L. Riverman, R. Bindschadler, D. M. Holland, and S. Anandakrishnan. Channelized ice melting in the ocean boundary layer beneath Pine Island Glacier, Antarctica. Science, 341(6151):1236-1239, 2013.

* cited by examiner

AUTONOMOUS SUBMERSIBLE SENSOR APPARATUS WITH PISTON DIVE CONTROL

STATEMENT OF GOVERNMENT INTEREST

This invention was made with government support under contract No. N00014-20-1-2741 awarded by the Office of Naval Research. The government has certain rights in the invention.

BACKGROUND OF THE DISCLOSURE

There is a growing need for inexpensive robots that detect important sub-surface ocean data (e.g., temperature, salinity, currents) in the upper ocean. However, the current ocean profilers are expensive and use proprietary software, making them difficult for users to customize to serve their individual applications. As a result, there is a need for an upper ocean profiling robot that increases accessibility to global marine data acquisition through reduced device costs and decreased training requirements.

In the prior art, there are programs, such as the Global Drifter Program and the Air-Sea Interaction Regional Initiative, each of which aims to deliver oceanic data at high enough resolution to satisfy the models to improve weather predictability and ocean health monitoring. In addition to remote sensing devices (e.g. satellites or shore-based systems), large arrays of in-situ technologies are deployed to take direct measurements of atmospheric, ocean surface and subsurface data. Each of these prior art technologies has its own benefits, costs and limitations, but the capital needed to deploy and maintain these technologies directly limits the spatial and temporal resolutions of these observations made throughout the ocean, in turn, limiting the accuracy of predictions, especially over longer time periods.

A variety of these prior art technologies have been employed that have supplied and had data sets accepted to the World Ocean Database. Ocean Station Data (OSD) comes from oceanographic research cruises and are often referred to as "bottle data" since the method to collect data often uses bottles, buckets, or net tows, which function by collecting discrete water samples that are later analyzed. This method dates to 1772. Since the gathered data can be later tested in a lab, a high percentage of these casts are further analyzed giving the ability to study multiple variables per cast, without having to equip the bottles themselves with arrays of expensive sensors.

Mechanical Bathythermograph (MBT) Data is collected by a tube that is dropped into the ocean to produce a temperature profile by recording temperature data versus depth using a 17 m long coiled Bourdon tube with a mechanical stylus that moves in one direction due to the Bourdon tube pressure and the other due to a temperature sensor. As it descends the stylus scratches the relation into a glass plate.

The Expendable Bathythermograph (XBT) is a three-part system with an expendable probe that sends temperature data over a copper wire to a launcher device which is operated from a ship, aircraft or submarine. The XBT has a maximum depth recording of just over 1800 m but the most popular versions focus on the upper 500 m of the ocean. The depth of the temperature readings is estimated using a depth-time equation with an accuracy of ±2% or 5 m whichever is largest.

Conductivity-Temperature-Depth (CTD) measures multiple ocean variables, with the default device typically including temperature, salinity and pressure. The vertical resolution of this device is high.

Moored Buoy (MRB) are surface floating devices which are anchored to the ocean floor. They collect both atmospheric and subsurface data which includes surface wind, rain rates, sea surface temperature, and humidity as well as subsurface temperature, current and salinity. The subsurface data is typically low vertical resolution.

Drifting Buoy (DRB) is a drifting buoy attached to ice drifts and has a subsurface profiling device tethered which measures ocean variables at a preprogrammed range of depths. A second style freely drifts in the ocean with a chain of subsurface sensors placed at discrete locations and a ballast at the end of the chain for stability.

Profiling Float (PFL) drift autonomously at a user defined depth and rise to the ocean surface to collect and transmit data via satellite. The original idea was developed by Swallow in 1955, which used a float that was neutrally buoyant at a pre-calibrated depth and was tracked by a ship to approximate ocean currents. This idea was improved through use of sonar in the 1960s with SOFAR which allowed for longer range tracking of the device. The latest profilers are based on a version of this device called the ALACE float which used a variable buoyancy device to ascend the water column after drifting and ARGOs satellite networks to communicate its locational data.

Autonomous Pinniped (APB) Data is gathered using recording devices attached to marine animals. Newer versions of this device are equipped with satellite communication which transmits data when the animal surfaces and are used to fill data gaps in harsh environments or remote areas of interest.

Glider (GLD) Data are autonomous vehicles, similar to profilers, which vary their buoyancy to descend into the ocean. The gliders have fins that allow them to descend at an angle in the ocean to traverse both vertical and horizontal distances. The Seaglider has a CTD and a fluorometer with optical/backscatter sensors, but the technology can be used to gather data from a wide range of ocean variables similar to profilers.

SUMMARY OF THE INVENTION

The present disclosure generally relates to a programmable, autonomous, sub-surface water data profiler. More specifically, the present disclosure provides a lightweight, efficient, autonomous water profiler that can be easily programmed and deployed to collect sample data at a variety of water depths.

The present disclosure features a unique, simple-to-use programmable, autonomous, sub-surface water data profiler. The device has a low-cost design with a low-cost depth control system that allows several dive/surface trips, an Android graphical interface for Bluetooth programming and a deployable antenna for retrieval after completing its mission. The data is collected using an open-source, user-friendly Android interface, and other ease-of-use implementations such as Bluetooth programming using Android and longer-range radio communications with a deployable antenna. The present design provides a product with a wider market appeal which is usable by anyone with a deep pond, lake, ocean or even a pool that they would like to monitor.

BRIEF DESCRIPTION OF THE DRAWINGS

While the specification concludes with claims particularly pointing out and distinctly claiming embodiments of the instant invention, various embodiments of the invention can be more readily understood and appreciated from the following descriptions of various embodiments of the invention when read in conjunction with the accompanying drawings in which:

DETAILED DESCRIPTION OF THE EXEMPLARY EMBODIMENTS

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon.

Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Figure 1:
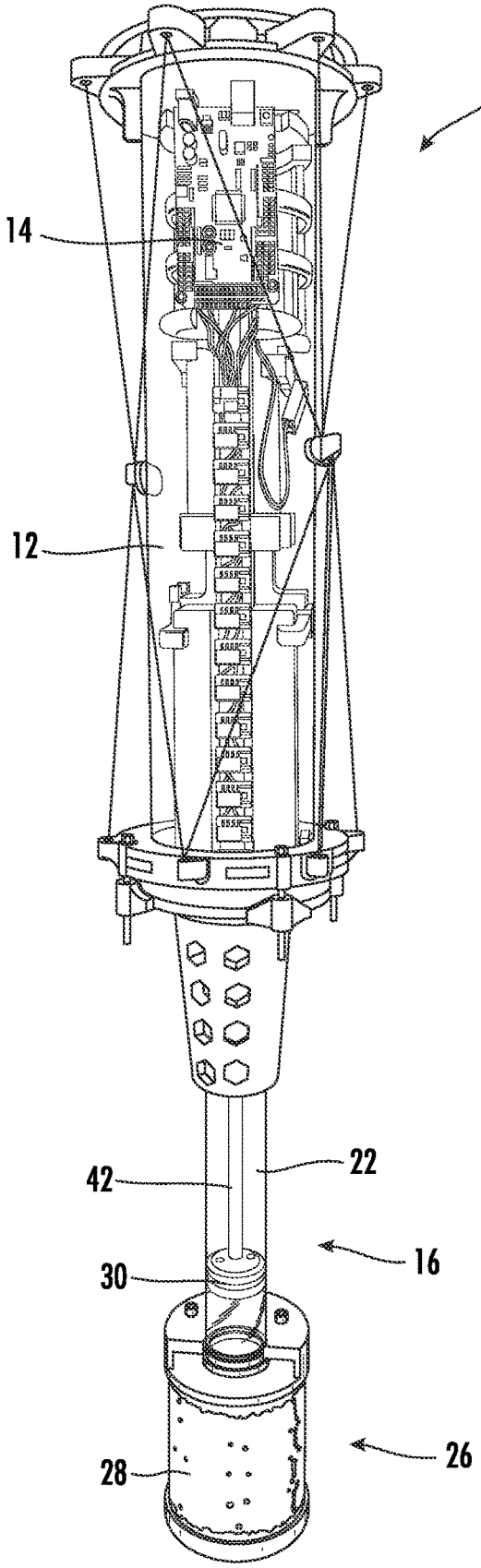
FIG. 1 is a front perspective view of an autonomous water profiler in accordance with the present disclosure.
Figure 2:
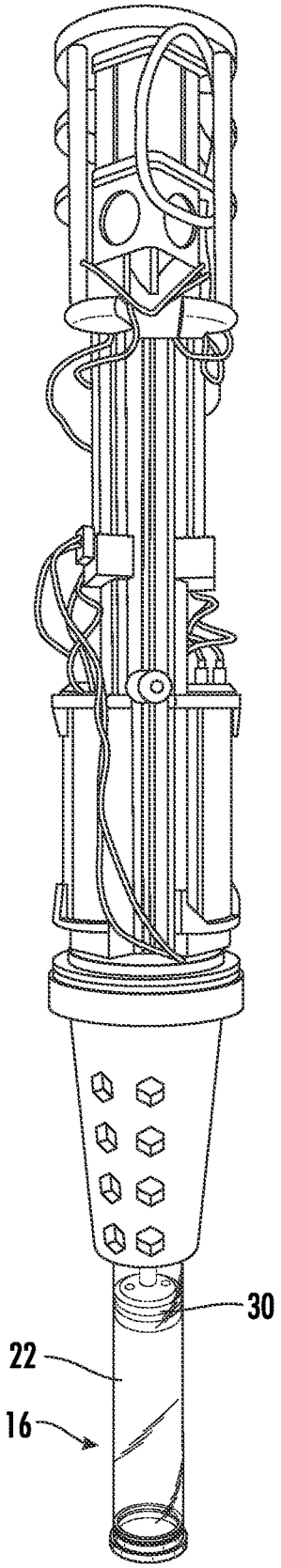
FIG. 2 is the autonomous water profiler of FIG. 1 with the waterproof housing removed.

Parts and components are labeled throughout the drawing figures for clarity. Referring now to FIGS. 1 and 2, the present disclosure describes a unique programmable, autonomous, sub-surface water data profiler 10. The profiler is a lightweight buoy device that is constructed to have a watertight, neutrally buoyant housing 12. Within the housing 12, the water data profiler 10 contains electronics 14 including but not limited to control electronics, water sensor electronics, communications systems, a power supply (battery) and a buoyancy engine 16 to control the depth to which the buoy descends to capture water data. Further the water data profiler 10 may have mounted within the housing 12 or on an exterior surface thereof a variety of sensors for detecting water temperature, pressure, salinity, position, depth, oxygen saturation as well as others. In addition, the device is preferably ballasted so as to remain in an upright position when deployed. In this manner the device as disclosed provides a lightweight, efficient, autonomous water profiler that can be easily programmed and deployed to collect sample data at a variety of water depths.

Figure 3:
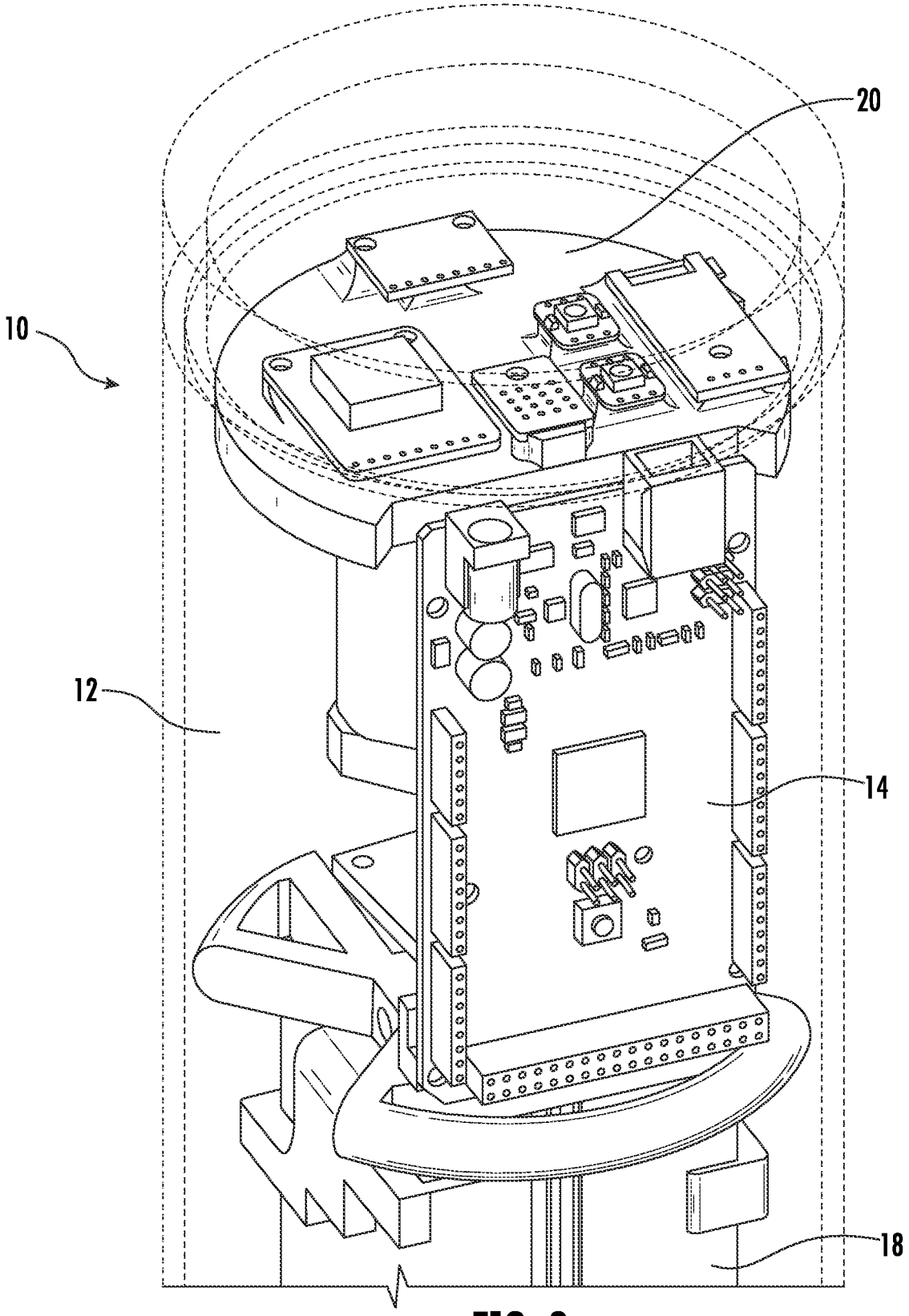
FIG. 3 is an enlarged view of the top end of the autonomous water profiler.

As seen in FIG. 3, the control system electronics 14, as disclosed, is powered by a rechargeable battery array 18 within the housing 12 that has sufficient reserve power to allow several dive/surface trips. A control circuit board 14 and communication circuit board 20 within the housing are powered by the batteries 18 and serve to host/operate an Android graphical interface for Bluetooth programming and a deployable antenna for retrieval after completing its mission. The collected data is achieved using an open-source user-friendly Android interface, and other ease-of-use implementations such as Bluetooth programming using Android and longer-range radio communications with a deployable antenna.

Figure 4:
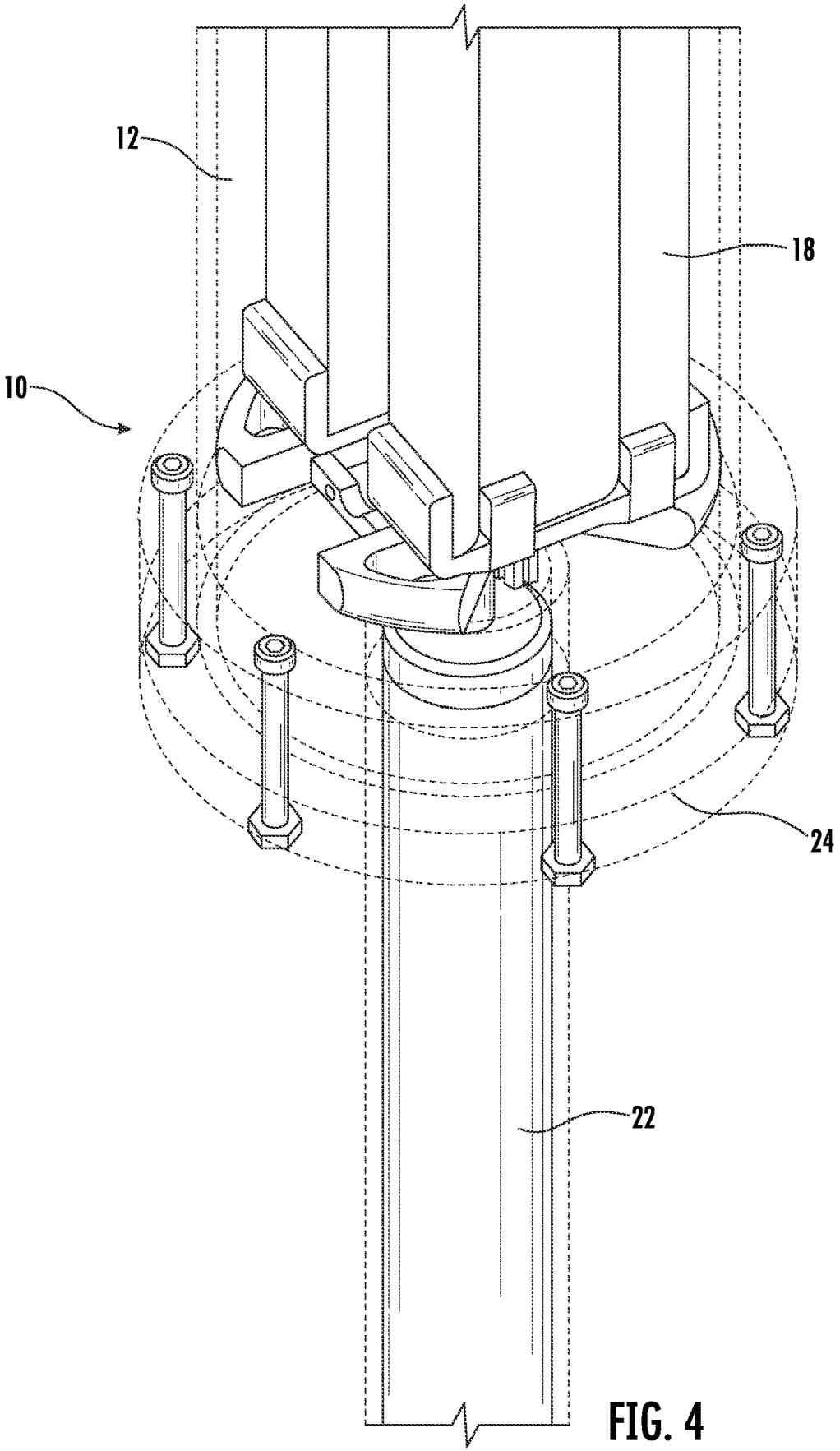
FIG. 4 is an enlarged view of the mid-section of the autonomous water profiler.

Turning to FIG. 4, the central portion of the water data profiler 10 is seen to transition from the housing 12 containing the electronics and batteries to a smaller diameter tube 22 that contains the dive/depth controller 16. A transition 24 is provided as between the housing 12 and the dive control tube 22. The transition 24, is a watertight joint between the upper housing 12 and the lower tube 22. It allows disassembly of the water data profiler 10 when needed for servicing and is attached using fasteners such as screws and includes gasketing to insure a watertight seal.

Figure 5:
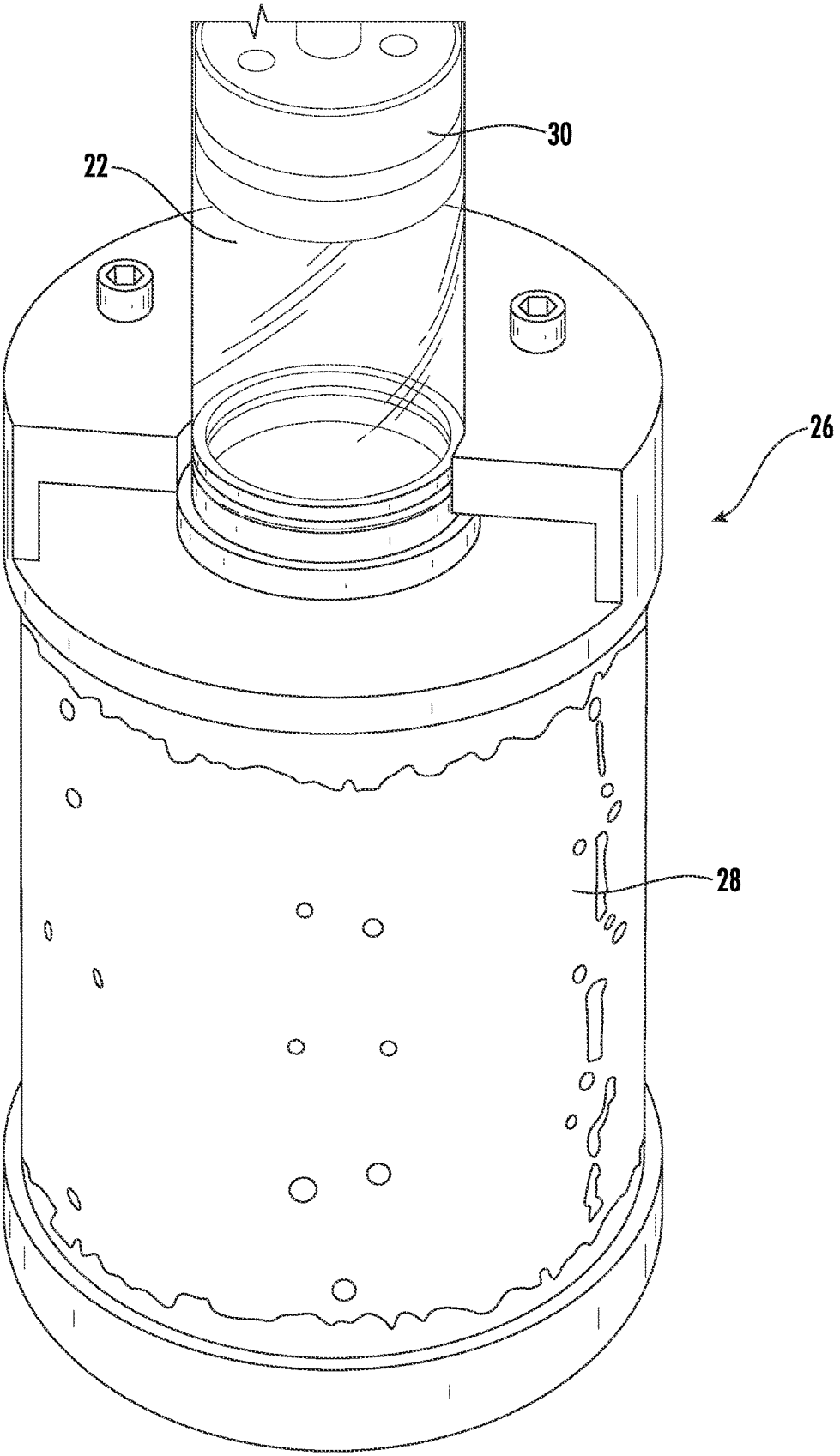
FIG. 5 is an enlarged view of the bottom end of the autonomous water profiler.

As shown in FIG. 5, a filtering screen 28 is shown on a foot 26 at the end of the dive control tube 22. The filtering screen 28 allows the flow of water from the environment into the dive control tube 22 to control buoyancy and dive depth of the water data profiler 10 as will described in detail below. The filtering screen 28 allows water to pass therethrough while preventing other debris from entering the dive control tube 22. Further, the foot 26 may be weighted or contain lead shot that can be adjusted in weight to calibrate the water data profiler 10 for neutral buoyancy as well as to keep the water data profiler 10 oriented in an upright vertical manner.

Figure 6:
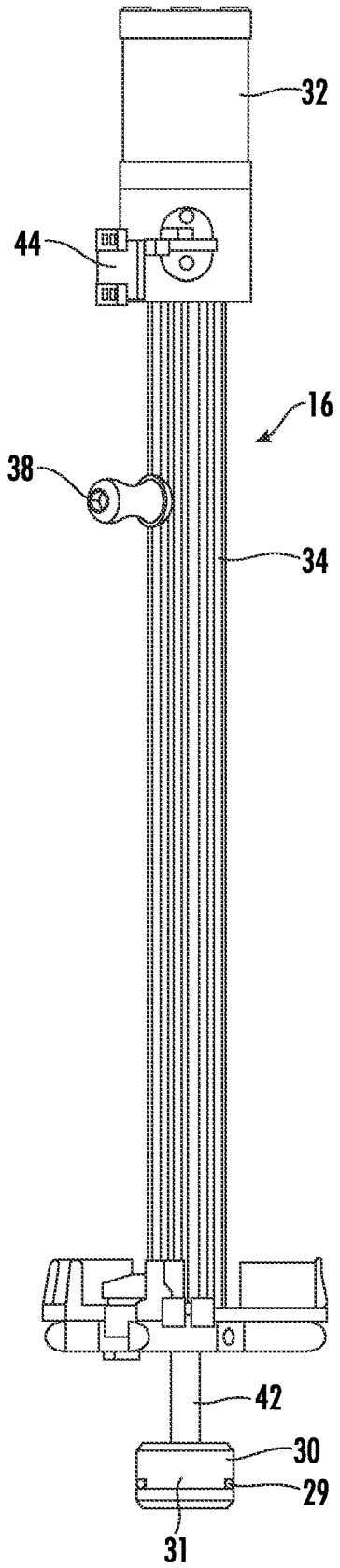
FIG. 6 is an assembly view of the buoyancy control of the autonomous water profiler.
Figure 7:
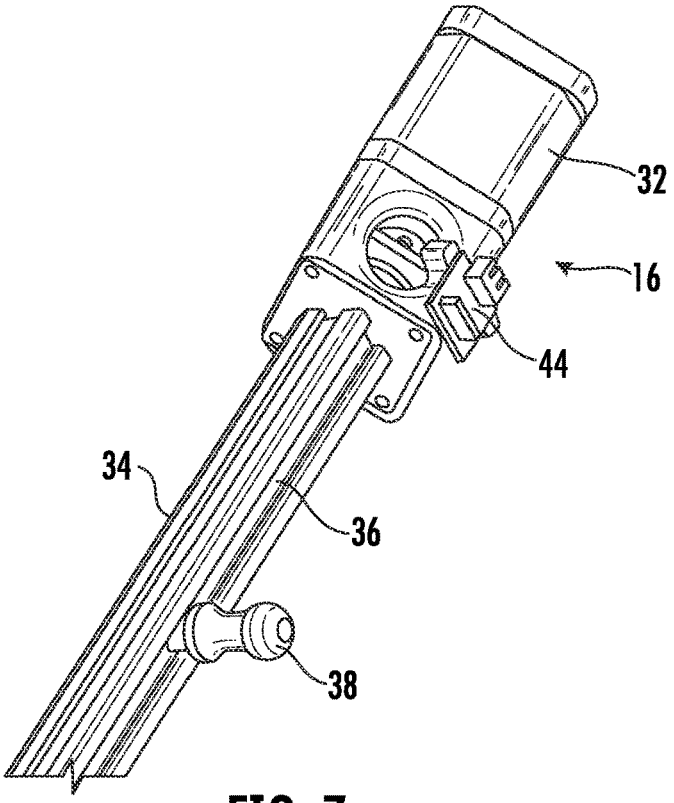
FIG. 7 is a top view of the buoyancy control of the autonomous water profiler.
Figure 8:
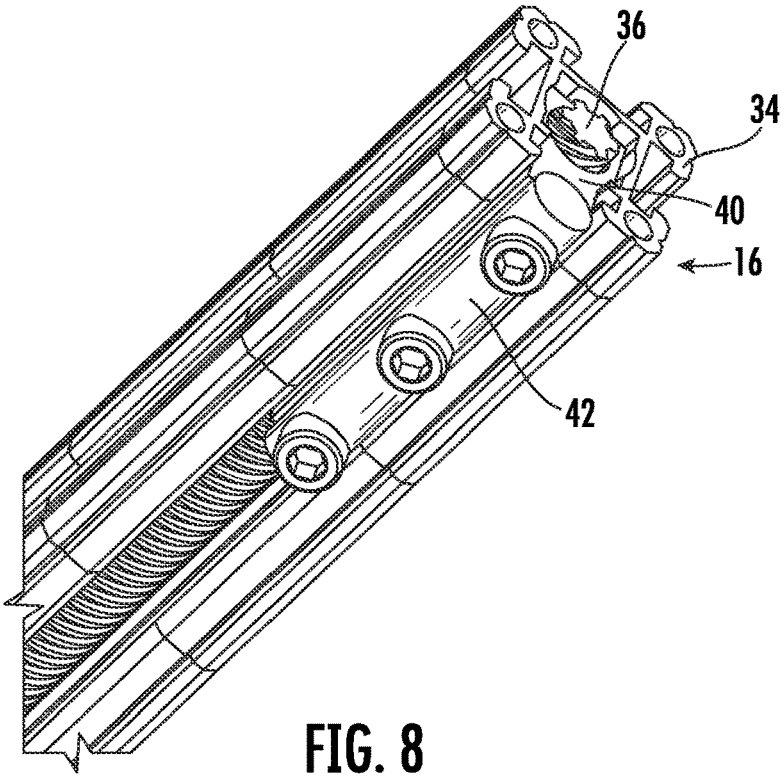
FIG. 8 is a detail view of the drive rail of the buoyancy control of the autonomous water profiler.

The buoyancy engine 16 is an assembly that is contained within the housing 12 and includes a piston 30 that extends into the dive control tube 22. An O-ring 29 or other suitable gasket is installed in a groove 31 about the piston to form a watertight seal between the piston 30 and the dive control tube 22 as the piston is displaced therein as will be discussed below. As can best be seen in FIGS. 6-8, the buoyancy engine 16 is shown apart from the water data profiler 10. The buoyancy engine 16 provides a design that is well suited to the upper ocean and operates on a principle where the piston 30 is displaced within the dive control tube 22 to draw water into and out of a the cylinder to produce and overall total density change of the water data profiler 10 which in turn allows the water data profiler 10 to sink or rise thereby changing its depth within the body of water.

A stepper motor 32 is provided to operate the buoyancy engine 16. The stepper motor 32 is preferably capable of 112 oz in of torque which limits the operational depth of the water data profiler 10 device to the upper 100 m due to the water pressure exerted on the piston 30 beyond that depth. While the current configuration's capabilities may exclude it from some deep-water applications, the device is capable of being easily scaled by increasing the hull dimensions, adding a more powerful motor, increasing the dive control tube 22 length or diameter, and adding higher capacity batteries.

As already stated, the dive control system 16 includes piston 30 and dive control tube 22 wherein the dive control tube 22 has a cylinder configuration where the cylinder has a greater length than its width/diameter, allowing a predetermined amount of displacement of either air or water by moving the piston 30 within the dive control tube 22. The length to width/diameter ratio may in some embodiments be between 1:1 to as much as 20:1. The dive control tube 22 has an opening to the exterior water environment to draw water in or expel water out to change buoyancy of the device.

A stepper motor 32 is coupled to the top end of a guide rail system 34 contained within a watertight housing structure. The guide rail system 34 provides lightweight torsional stability as a guide to move the piston 30 up and down based on rotation of the stepper motor 32. A threaded rod 36, positioned within the guide rail 34 is driven in a rotational manner by the stepper motor 32, which in turn engages with a setscrew end stop trigger 38 or collar 40. As the threaded rod 36 rotates, it engages with threads in the end stop trigger 38 or collar 40 causing the end stop trigger 38 or collar 40 to advance or retract along the guide rail 34. In turn, the end stop trigger 38 or collar 40 is engaged with a piston rod 42 that engages the piston 30 positioned within the dive control tube 22 that is internal to the housing and having an end open to the exterior water environment. As the piston rod 42 drives the piston 30 down, water is discharged and the air compression within the water data profiler 10 is reduced causing a greater volume of displacement, which as a result, causes the water data profiler 10 to rise. By retracting the piston 30, water is drawn into the end of the dive control tube 22 and the air within the water data profiler 10 is compressed which reduces the volume of displacement and causes the water data profiler 10 to sink. By controlling the stepper motor 32 via control electronics 44 that contain a preprogrammed dive profile the device can autonomously execute changes in depth to follow the desired sampling pattern. There are two limit switches mounted at the upper and lower extents of the guide rail 34 that are triggered by the setscrew stop trigger to prevent over travel of the piston 30.

Figure 9:
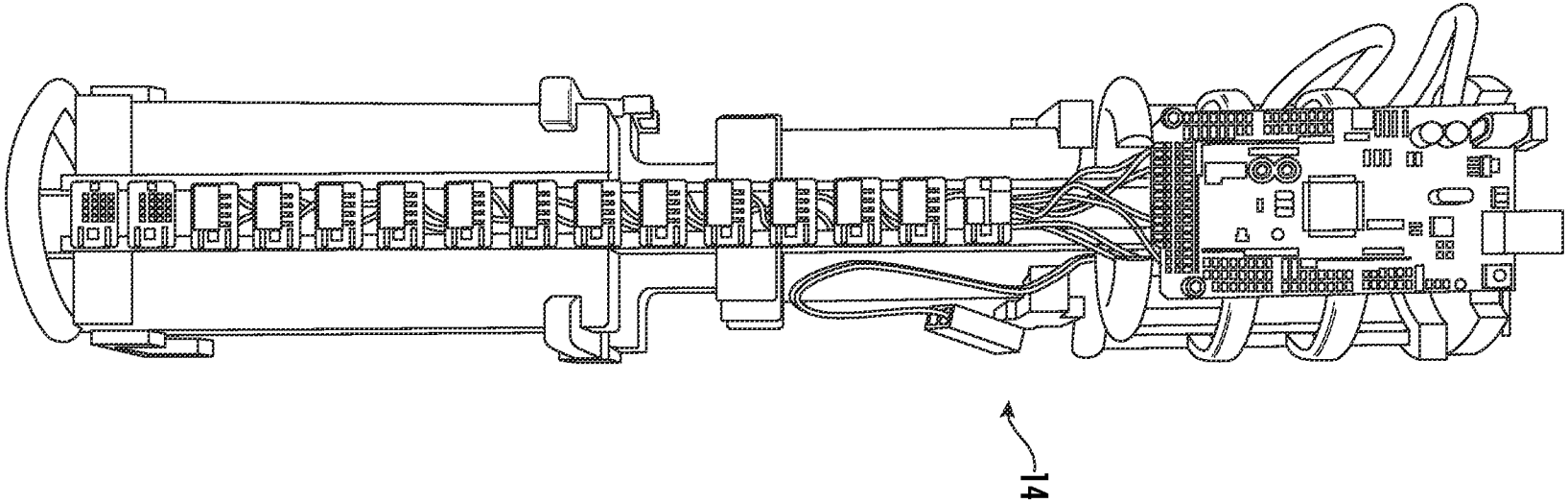
FIG. 9 is view of the control circuitry of the autonomous water profiler.

As shown at FIG. 9 the present disclosure features an electronic control module 14 that employs simple-to-use programmable, autonomous, sub-surface water data profiler. An Android graphical interface for Bluetooth programming and a deployable antenna for retrieval after completing its mission. The data is collected using an open-source, user-friendly Android interface, and other ease-of-use implementations such as Bluetooth programming using Android and longer-range radio communications with a deployable antenna. Further the water data profiler 10 may have mounted within the housing 12 or on an exterior surface thereof a variety of sensors for detecting water temperature, pressure, salinity, position, depth, oxygen saturation as well as others. As a result, the present design provides a product with a wider market appeal which is usable by anyone with a deep pond, lake, ocean or even a pool that they would like to monitor.

One major application for the device of the present disclosure is the study of the ocean mixed layer, which plays a large roll in systems of energy transfer and biological productivity. The mixed layer is typically tens of meters deep and is a locally uniform region of the ocean which is mixed mostly by wind shear and convective motion from heat loss or gain from the diurnal cycle. Knowing the physical characteristics of the fluid in and just below the mixed layer, such as the depth and strength of the temperature and salinity stratification, gives valuable insight into the ocean's energy budget and potential for upwelling which introduces nutrient rich waters from below into the photic zone allowing for production of phytoplankton.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An autonomous submersible sensor apparatus for collecting data at variable depths in water environments comprising:

a modular submersible housing including:

an instrument housing;

a dive control system removably secured in coaxial relation with a lower end of said instrument housing, said dive control system having a dive control tube in fluid communication with the external water environment;

a weighted foot removably secured in coaxial relation with a lower end of said dive control tube;

a circuit board having control, communication and sensor electronics thereon contained within said instrument housing;

a dive control piston slidably received within said dive control tube, wherein dive control piston is slidably movable within said dive control tube to selectively intake of expel water within said dive control tube to change the overall density of said modular submersible housing and thereby selectively control an operating depth of said apparatus.

2. The autonomous submersible sensor apparatus for collecting data at variable depths in water environments of claim 1, further comprising:

an axial linear actuator secured to said dive control piston, and a motor to control selective movement of said linear actuator and said dive control piston within said dive control tube; and a depth control system within said instrument housing and in communication with said electronic sensor package and said motor.

3. The autonomous submersible sensor apparatus for collecting data at variable depths in water environments of claim 1, wherein a weight of said weighted foot is adjustable to calibrate a neutral buoyancy of said modular submersible housing.

4. The autonomous submersible sensor apparatus for collecting data at variable depths in water environments of claim 1, said dive control system further comprising:

a guide rail;

a threaded rod rotatably received within said guide rail, said threaded rod being rotatably driven by said motor;

a coupler having corresponding threads therein received about said threaded rod, wherein said piston is affixed to said coupler;

a motor to control rotation of said threaded rod causing selective linear movement of said coupler and said dive control piston within said dive control tube; and a depth control system within said instrument housing and in communication with said electronic sensor package and said motor.

5. The autonomous submersible sensor apparatus for collecting data at variable depths in water environments of claim 1, wherein:

the electronic control system is pre-programmable to autonomously control operation of said dive control piston for autonomous depth control and data collection.

6. The autonomous submersible sensor apparatus for collecting data at variable depths in water environments of claim 1, wherein:

the ratio of a length of the dive control tube to a width/diameter of the dive control tube is greater than 3:1.

7. The autonomous submersible sensor apparatus for collecting data at variable depths in water environments of claim 1, wherein:

the ratio of a length of the dive control tube to a width/diameter of the dive control tube is greater than 5:1.

8. The autonomous submersible sensor apparatus for collecting data at variable depths in water environments of claim 1, wherein:

the ratio of a length of the dive control tube to a width/diameter of the dive control tube is greater than 10:1.

9. The autonomous submersible sensor apparatus for collecting data at variable depths in water environments of claim 1, wherein the communication electronics on said circuit board allow wireless data transmission to and from the autonomous submersible sensor apparatus.

10. The autonomous submersible sensor apparatus for collecting data at variable depths in water environments of claim 9, wherein the communication with said communication electronics on said circuit board is via Bluetooth or longer range radio communication.

* * * * *